US010822888B2

(12) United States Patent
Sim

(10) Patent No.: US 10,822,888 B2
(45) Date of Patent: Nov. 3, 2020

(54) SACRIFICIAL PROTECTOR SLEEVE

(71) Applicant: Halliburton Energy Services, Inc., Houston, TX (US)

(72) Inventor: Nicholas Kok Jun Sim, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/072,607

(22) PCT Filed: Mar. 7, 2016

(86) PCT No.: PCT/US2016/021191
§ 371 (c)(1),
(2) Date: Jul. 25, 2018

(87) PCT Pub. No.: WO2017/155502
PCT Pub. Date: Sep. 14, 2017

(65) Prior Publication Data

US 2019/0040695 A1 Feb. 7, 2019

(51) Int. Cl.

| | |
|---|---|
| ***E21B 17/10*** | (2006.01) |
| ***E21B 23/03*** | (2006.01) |
| *E21B 21/10* | (2006.01) |

(52) U.S. Cl.
CPC ..... *E21B 17/1085* (2013.01); *E21B 17/10* (2013.01); *E21B 17/1007* (2013.01); *E21B 23/03* (2013.01); *E21B 21/10* (2013.01)

(58) Field of Classification Search
CPC .. E21B 17/1085; E21B 17/1007; E21B 17/10; E21B 17/1042; E21B 23/03; E21B 23/00; E21B 23/02; E21B 34/06; F16L 58/00
See application file for complete search history.

(56) References Cited

U.S. PATENT DOCUMENTS 5,617,918 A * 4/1997 Cooksey ..... B25C 1/008 166/115
8,695,714 B2 * 4/2014 Xu ..... E21B 33/134 166/118
9,033,055 B2 * 5/2015 McCoy ..... E21B 34/063 166/373

(Continued)

FOREIGN PATENT DOCUMENTS

WO WO 2005/072354 A1 8/2005

OTHER PUBLICATIONS

International Search Report and The Written Opinion of the International Search Authority, or the Declaration, dated Dec. 7, 2016, PCT/US2016/021191, 19 pages, ISA/KR.

(Continued)

*Primary Examiner* — David J Bagnell
*Assistant Examiner* — Yanick A Akaragwe
(74) *Attorney, Agent, or Firm* — Haynes and Boone, LLP

(57) ABSTRACT

A method of protecting a nipple profile of a downhole tool that forms a portion of a tubing string and that is exposed to through-tubing completion operations includes securing a single-trip protective sleeve to the tool so that the sleeve covers the nipple profile of the tool during the completion operations and dissolving the single-trip protective sleeve so that it breaks away from the nipple profile to expose the nipple profile for use.

15 Claims, 2 Drawing Sheets

(56) References Cited

U.S. PATENT DOCUMENTS

| | | | | |
|---|---|---|---|---|
| 2006/0124320 | A1 | 6/2006 | Smith et al. | |
| 2008/0099209 | A1 | 5/2008 | Loretz et al. | |
| 2009/0314492 | A1 | 12/2009 | Reid et al. | |
| 2010/0032151 | A1* | 2/2010 | Duphorne | E21B 23/02 166/55 |
| 2011/0094742 | A1 | 4/2011 | Badalamenti et al. | |
| 2011/0239639 | A1* | 10/2011 | Farmer | E21B 34/10 60/413 |
| 2016/0326837 | A1* | 11/2016 | Bowen | E21B 34/063 |
| 2018/0328140 | A1* | 11/2018 | Schmidt | E21B 21/103 |

OTHER PUBLICATIONS

Nipple Protector for Frac, https://priorart.ip.com/IPCOM/000233955.

* cited by examiner

SACRIFICIAL PROTECTOR SLEEVE

PRIORITY

The present application is a U.S. National Stage patent application of International Patent Application No. PCT/US2016/021191, filed on Mar. 7, 2016, the benefit of which is claimed and the disclosure of which is incorporated herein by reference in its entirety.

TECHNICAL FIELD

The present disclosure relates generally to well completion operations and, more specifically, to a sacrificial protector sleeve used to protect interior geometries of a downhole tool during completion operations.

BACKGROUND

After a well is drilled and a target reservoir has been encountered, a completion operation may be performed, which may include gravel packing or hydraulic fracturing. Often, through-tubing hydraulic fracturing or gravel packing may be performed through a tubing string that includes a tool, such as a tubing retrievable safety valve, that has a nipple profile. The injection of fluids during through-tubing completion operations (hydraulic fracturing fluid in the case of through-tubing hydraulic fracturing and a slurry in the case of gravel packing) can cause erosion damage to the nipple profile of the tool. As such, nipple protectors are often placed downhole and secured relative to the tool to fluidically isolate or partially isolate the nipple profile from the injected fluids. These nipple protectors are generally run downhole and set using wireline or coiled tubing. After the injection of fluids is completed, the wireline or coiled tubing will be run downhole again to retrieve the nipple protectors from the nipple profiles.

However, the nipple protectors often do not fluidically isolate the nipple profile from the injected fluids and proppant from the slurry may enter an annulus formed between the nipple protector and the tool. This may result in the nipple protector becoming jammed in the tool and thus prevent successful retrieval of the tool.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
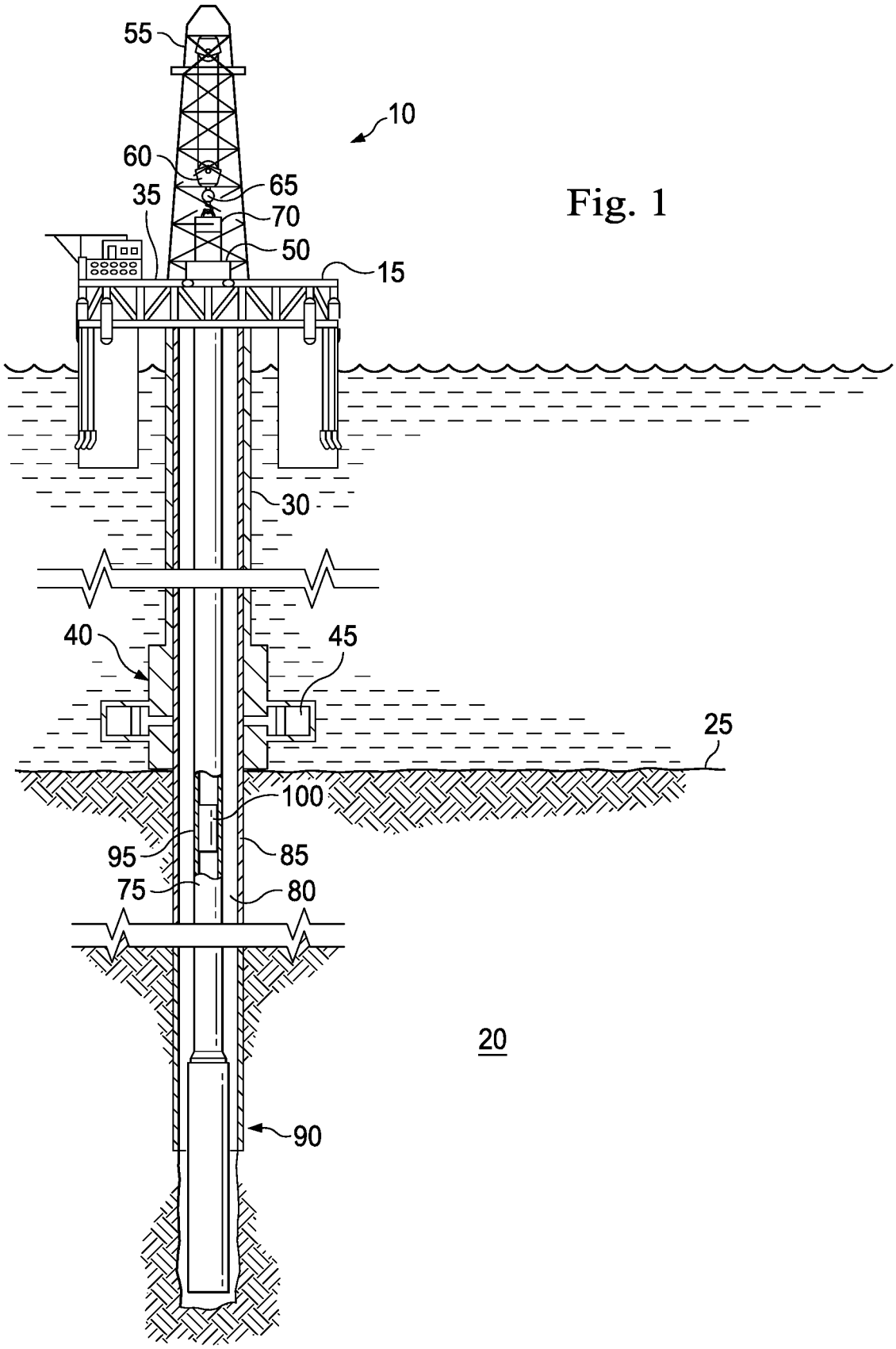
FIG. 1 is a schematic illustration of an oil and gas rig coupled to a tubing retrievable safety valve and a sacrificial protector sleeve, according to an embodiment of the present disclosure.

Illustrative embodiments and related methods of the present disclosure are described below as they might be employed in a sacrificial protector sleeve and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

FIG. 1 is a schematic illustration of an offshore oil and gas platform generally designated 10, operably coupled by way of example to a sacrificial protective sleeve according to the present disclosure. Such an assembly could alternatively be coupled to a semi-sub or a drill ship as well. Also, even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores or the like.

Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. The platform 15 may have a hoisting apparatus 50, a derrick 55, a travel block 60, a hook 65, and a swivel 70 for raising and lowering pipe strings, such as a substantially tubular, axially extending tubing string 75.

As in the present example embodiment of FIG. 1, a wellbore 80 extends through the various earth strata including the formation 20, with a portion of the wellbore 80 having a casing string 85 cemented therein. Disposed in the wellbore 80 is a completion assembly 90.

Generally, the assembly 90 may be any one or more completion assemblies, such as for example a hydraulic fracturing assembly, a gravel packing assembly, etc. The assembly 90 may be coupled to the tubing string 75 which includes a downhole tool 95 having a sacrificial protector sleeve 100 disposed therein (shown in greater detail in FIG. 2).

Figure 2:
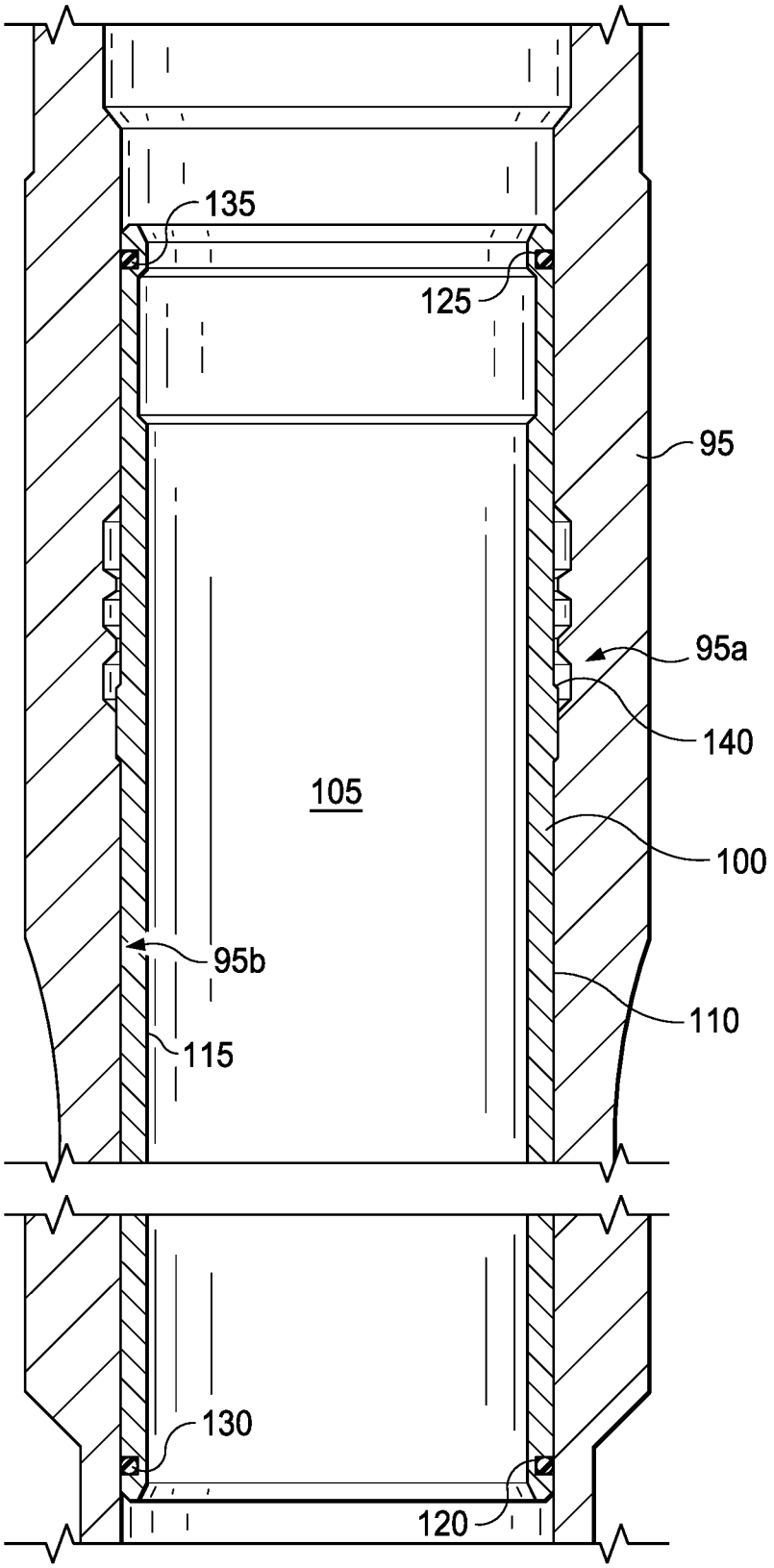
FIG. 2 illustrates a sectional view of the tubing retrievable safety valve and the sacrificial protector sleeve of FIG. 1, according to an exemplary embodiment of the present disclosure.

FIG. 2 illustrates the sleeve 100 secured, or locked, to the tool 95. The sleeve 100 forms a longitudinally extending fluid passageway 105. The sleeve 100 has an exterior surface 110 and an interior surface 115 that defines the passageway 105. Annular grooves 120 and 125 may be formed within the exterior surface 110. The grooves 120 and 125 may accommodate sealing elements 130 and 135, respectively. The sealing elements 130 and 135 may be o-rings or any other similar device. In one or more exemplary embodiment, one or both of the sealing elements 130 and 135 are elastomeric seals. The exterior surface may also form a protrusion or a plurality of protrusions 140 located axially between the grooves 120 and 125. The annular protrusions 140 generally correspond with at least a portion of a nipple profile 95*a* formed in the tool 95. However, the annular protrusions 140 may form a portion of a "rest on no-go", "snap in", "drop off", and "lock in" type configurations for securing or locking the sleeve 100 to any portion of the tool 95.

The sleeve 100 may be composed of a first material that reacts upon exposure to a first liquid. In an exemplary embodiment, the first material is, such as for example, a metal including aluminum, magnesium, zinc, iron, alloys of these metals and the like; a plastic including a polymer; or any combination thereof. In one or more examples, the first liquid may be a completion fluid, production hydrocarbons, a slurry, etc. In one or more exemplary embodiments, the first liquid may be, such as for example, any one of an acid, a carboxylic acid, a sulfonic acid, an organic acid, a sulfuric acid, a hydrochloric acid, a nitric acid, an inorganic acid, an ammonium, a Lewis acid, a base, a hydroxide, a potassium hydroxide, a sodium hydroxide, a strong base, an acetone, a Lewis base, a gasoline, a hydrocarbon, an alcohol, water, and a chloride.

The sealing elements 130 and 135 may be composed of the first material or a second material that is different than the first material. In an exemplary embodiment, the sealing elements 130 and 135 are dissolvable elastomer o-rings.

The tool 95 may be a safety valve, such as a tubing retrievable safety valve ("TRSV"), or any other type of tool that has a nipple profile, or other interior geometry, that may be damaged during completion operations or any other type of downhole operations or well intervention activities. Generally, the tool 95 is composed of a material that is different from the first material of the sleeve 100 and the second material of the sealing elements 130 and 135.

In operation, the sleeve 100 is run downhole through an interior passageway of the tubing string 75 and locked, or secured relative to the tool 95 using the plurality of protrusions 140 prior to the fracturing, gravel packing, or other activity. The sleeve 100 may be locked, or secured relative to the tool 95 when at least one of the plurality of protrusions 140 is accommodated or "set" within a corresponding interior geometry of the tool 95, such as for example, the nipple profile 95*a* of the tool 95. When locked relative to the tool 95, the sleeve 100 isolates and protects an interior geometry of the tool 95, such as for example the nipple profile 95*a*, a seal bore 95*b*, etc. Once the sleeve 100 is locked relative to the tool 95, completion operations may begin, such as for example, the slurry may be injected downhole and through an interior passageway of the tubing string 75 and the passageway 105. During completion operations, the interior geometry of the tool 95 will be isolated or at least shielded from the injected slurry by the sleeve 100. The sealing elements 130 and 135 prevents or at least discourages the injected slurry from entering an annulus formed between the tool 95 and the sleeve 100, where the annulus is at least partially defined by the interior geometry of the tool 95 and the sleeve 100. After a certain period of time after exposure to the first fluid, the sleeve 100 is dissolved and/or weakened such that the sleeve 100 unlocks and breaks away from the tool 95. Thus, the sleeve 100 dissolves into a plurality of pieces that are flushed down the interior passage of the tubing string 75 to reveal the previously-protected interior geometry of the tool 95. In the event that the injected slurry enters into the annulus formed between the tool 95 and the sleeve 100, the injected slurry may be washed away from the tool 95 by production fluid to allow for full operation of the tool 95.

In one or more exemplary embodiments, the sleeve 100 begins to dissolve and weaken when exposed to the first fluid within the wellbore 80, which may be present in the wellbore 80 prior to the sleeve 100 locking to the tool 95, may be introduced prior to start of completion operations, may be introduced during completion operations, may be introduced after the completion operations, or may be introduced anytime in-between. Regardless, upon the injection of the first fluid through the sleeve 100, the sleeve 100 begins to dissolve and weaken. The first fluid dissolves the sleeve 100 at a rate such that the sleeve 100 unlocks at a predetermined time or time range soon after the completion operation is completed. Additionally, the sealing elements 130 and 135 may dissolve and weaken to unlock in a similar manner to the sleeve 100, although it may occur independently of the type of fluid injected in the wellbore 80. In an exemplary embodiment, the dissolution rate of the sleeve 100 is dependent upon the first fluid and the temperature of the first fluid within the wellbore 80. In an exemplary embodiment, the temperature of the first fluid within the wellbore 80 is between about 80° F. and 300° F.

Thus, the sleeve 100 protects the internal geometry of the tool 95 from erosion damage or other types of damage when the injected fluids pass through the tool 95 at high flow rates that are often associated with completion operations. The sleeve 100 is a sacrificial sleeve that protects components of the tool 95 from erosion damage and then dissolves within a predetermined amount of time when exposed to the first fluid. In an exemplary embodiment, the sleeve 100 does not require retrieval after it is locked relative to the tool 95. As such, the sleeve 100 avoids time spent and costs associated with a nipple protector retrieval. Additionally, the sleeve 100 avoids costly intervention operations associated with retrieving a protector sleeve that is jammed, or stuck to, the tool 95. Accordingly, costs and time spent to retrieve a jammed sleeve 100 are avoided. Thus, the sleeve 100 is a single-trip protective sleeve used to protect interior-facing tool components from slurries injected at high flow rates. In an exemplary embodiment and due to the sleeve 100 dissolving to expose the internal geometry of the tool 95, the sleeve 100 has a tool-less release mechanism or is a self-removing sleeve. As such, mechanical release mechanisms found in conventional protectors are not necessary, which simplifies the design and manufacture (and thus the cost) of the sleeve 100.

Exemplary embodiments of the present disclosure can be altered in a variety of ways. In some embodiments, the annular protrusions 140 generally correspond to a lock profile and/or a no-go shoulder formed within an interior surface of the tool 95 that is spaced from the nipple profile 95*a* of the tool 95. In this exemplary embodiment, the lock profile and/or no-go shoulder may be uphole relative to the nipple profile 95*a* of the tool 95. However, the length of the sleeve 100 extends over the nipple profile 95*a* of the tool 95 such that the annular groove 125 and sealing element 135 extend below, or downhole, from the nipple profile 95*a* of the tool 95 when the plurality of protrusions 140 are locked to the lock profile and/or the no-go shoulder of the tool 95. Thus, the engagement of the plurality of protrusions 140 with the nipple profile 95*a* is not required for the sleeve 100 to protect the nipple profile 95*a*. Additionally, the axial length of the sleeve 100 may be sized to isolate other tool components, such as for example, a flow tube and flapper, etc.

In an exemplary embodiment, the tool 95 is a TRSV and the completion operation is through-TRSV cementing. Thus, sleeve 100 minimizes contact between injected cement and the internal geometry of the TRSV. However, the sleeve 100 may protect the interior geometry of the tool 95 from any injected fluid, whether the injected fluid be the slurry as described above in relation to FIG. 2, the cement, a hydraulic fracturing fluid, or other injected fluid whether injected at a high flow rate or otherwise.

In an exemplary embodiment, the interior geometry of the tool 95, such as for example, the nipple profile 95*a* and or the seal 95*b*, are interior-facing tool components, which also may include flow tubes, flappers, etc.

In an exemplary embodiment, the sacrificial sleeve 100 is locked or set in place at the surface of the well. Therefore, the sleeve 100 is locked to the tool 95 at the surface of the well and is run downhole with the tool 95.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a method has been described. Embodiments of the method may generally extending a sacrificial sleeve within an interior passageway of a tool; securing the sacrificial sleeve to the tool such that an interior-facing tool component of the tool is covered by the sacrificial sleeve; passing a first fluid through an interior passageway of the sacrificial sleeve; and dissolving the sacrificial sleeve using the first fluid to uncover the interior-facing tool component. For any of the foregoing embodiments, the completion assembly may include any one of the following elements, alone or in combination with each other:

- The tool forms a portion of a tubing string that extends within a wellbore; the method further includes injecting a second fluid through a fluid passageway of the tubing string and towards a completion assembly that is coupled to the tubing string; and the interior-facing tool component is shielded from the second fluid when covered by the sacrificial sleeve.
- The tool is a tubing retrieval safety valve and the interior-facing tool component is at least one of a nipple profile and a seal bore.
- Securing the sacrificial sleeve to the tool such that the interior-facing tool component of the tool is covered by the sacrificial sleeve includes setting a protrusion formed on an exterior surface of the sacrificial sleeve within a nipple profile that is the interior-facing tool component.
- The first fluid includes at least one of an acid, an ammonium, a base, an hydroxide, an acetone, a gasoline, a hydrocarbon, an alcohol, water, and a chloride.
- Sealingly engaging an annular seal with an exterior surface of the sacrificial sleeve and an interior surface of the tool to at least resist fluid flow into an annulus formed between the tool and the sacrificial sleeve.
- Dissolving the annular seal using the first fluid.
- The interior-facing geometry is at least one of a nipple profile or a seal bore.
- The sacrificial sleeve is a single-trip protective sleeve.
- The first fluid comprises at least one of a completion fluid, a production hydrocarbon, and a slurry.

Thus, a method of protecting a nipple profile of a tool, the tool forming a portion of a tubing string has been described. Embodiments of the method may generally include concentrically disposing a single-trip protective sleeve within an interior passageway at least partially formed by the nipple profile of the tool such that the sleeve covers the nipple profile of the tool; accommodating an external protrusion on the sleeve within the nipple profile of the tool to secure the sleeve to the tool; injecting a first fluid through the interior passageway, wherein the nipple profile is protected from the first fluid by the sleeve; and at least one of: continuing to inject the first fluid through the interior passageway to dissolve the sleeve so that the nipple profile is not covered by the sleeve; and injecting a second fluid through the interior passageway to dissolve the sleeve so that the nipple profile is not covered by the sleeve. For any of the foregoing embodiments, the method may include any one of the following, alone or in combination with each other:

- The second fluid includes at least one of an acid, an ammonium, a base, an hydroxide, an acetone, a gasoline, a hydrocarbon, an alcohol, water, and a chloride.
- Sealingly engaging an annular seal with an exterior surface of the sleeve and an interior surface of the tool to at least resist flow of the first fluid into an annulus formed between the tool and the sleeve.
- Dissolving the annular seal using at least one of the first fluid and the second fluid.
- The first fluid includes at least one of an acid an acid, an ammonium, a base, an hydroxide, an acetone, a gasoline, a hydrocarbon, an alcohol, water, and a chloride.
- The first fluid includes at least one of a completion fluid, a production hydrocarbon, and a slurry.

Thus, a single-trip, sacrificial protector sleeve has been described. Embodiments of the apparatus may generally include single-trip, sacrificial protector sleeve for concentric disposal within an interior passageway of a tool having an internal geometry, wherein the sleeve has an external protrusion that corresponds with the internal geometry of the tool to secure the sleeve within the tool such that the sleeve extends over the internal geometry when the sleeve is concentrically disposed within the interior passageway of the tool; and wherein the sleeve is adapted to dissolve within a predetermined amount of time to expose the internal geometry after exposure to a first fluid. For any of the foregoing embodiments, the method may include any one of the following, alone or in combination with each other:

- A first and second annular groove formed on the exterior surface of the single-trip, sacrificial protector sleeve; a first annular seal disposed in the first groove that sealing engages the single-trip, sacrificial protector sleeve and the tool when the sleeve is concentrically disposed within the interior passageway of the tool; and a second annular seal disposed in the second groove that sealing engages the single-trip, sacrificial protector sleeve and the tool when the sleeve is concentrically disposed within the interior passageway of the tool.

The tool is a tubing-retrievable safety valve and the internal geometry is a nipple profile.

The internal geometry is at least one of a nipple and a bore seal.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A method comprising:

extending a sacrificial sleeve within an interior passageway of a tool;

securing the sacrificial sleeve to the tool such that an interior-facing tool component of the tool is covered by the sacrificial sleeve;

passing a first fluid through an interior passageway of the sacrificial sleeve;

dissolving the sacrificial sleeve using the first fluid to uncover the interior-facing tool component;

sealingly engaging an annular seal with an exterior surface of the sacrificial sleeve and an interior surface of the tool to at least resist fluid flow into an annulus formed between the tool and the sacrificial sleeve; and dissolving the annular seal using the first fluid.

2. The method of claim 1, wherein the tool forms a portion of a tubing string that extends within a wellbore;

wherein the method further comprises injecting a second fluid through a fluid passageway of the tubing string and towards a completion assembly that is coupled to the tubing string; and wherein the interior-facing tool component is shielded from the second fluid when covered by the sacrificial sleeve.

3. The method of claim 1, wherein the tool is a tubing retrieval safety valve and the interior-facing tool component is at least one of a nipple profile and a seal bore.

4. The method of claim 1, wherein securing the sacrificial sleeve to the tool such that the interior-facing tool component of the tool is covered by the sacrificial sleeve comprises setting a protrusion formed on an exterior surface of the sacrificial sleeve within a nipple profile that is the interior-facing tool component.

5. The method of claim 1, wherein the first fluid comprises at least one of an acid, an ammonium, a base, an hydroxide, an acetone, a gasoline, a hydrocarbon, an alcohol, water, and a chloride.

6. The method of claim 1, wherein the interior-facing geometry is at least one of a nipple profile or a seal bore.

7. The method of claim 1, wherein the sacrificial sleeve is a single-trip protective sleeve.

8. The method of claim 1, wherein the first fluid comprises at least one of a completion fluid, a production hydrocarbon, and a slurry.

9. A method of protecting a nipple profile of a tool, the tool forming a portion of a tubing string, the method comprising:

concentrically disposing a single-trip protective sleeve within an interior passageway at least partially formed by the nipple profile of the tool such that the sleeve covers the nipple profile of the tool;

accommodating an external protrusion on the sleeve within the nipple profile of the tool to secure the sleeve to the tool;

injecting a first fluid through the interior passageway, wherein the nipple profile is protected from the first fluid by the sleeve;

at least one of:

continuing to inject the first fluid through the interior passageway to dissolve the sleeve so that the nipple profile is not covered by the sleeve; and injecting a second fluid through the interior passageway to dissolve the sleeve so that the nipple profile is not covered by the sleeve sealingly engaging an annular seal with an exterior surface of the sleeve and an interior surface of the tool to at least resist flow of the first fluid into an annulus formed between the tool and the sleeve; and dissolving the annular seal using at least one of the first fluid and the second fluid.

10. The method of claim 9, comprising injecting the second fluid through the interior passageway to dissolve the sleeve so that the nipple profile is not covered by the sleeve, wherein the second fluid comprises at least one of an acid, an ammonium, a base, an hydroxide, an acetone, a gasoline, a hydrocarbon, an alcohol, water, and a chloride.

11. The method of claim 9, comprising continuing to inject the first fluid through the interior passageway to dissolve the protective sleeve so that the nipple profile is not covered by the protective sleeve, wherein the first fluid comprises at least one of an acid an acid, an ammonium, a base, an hydroxide, an acetone, a gasoline, a hydrocarbon, an alcohol, water, and a chloride.

12. The method of claim 9, wherein the first fluid comprises at least one of a completion fluid, a production hydrocarbon, and a slurry.

13. A single-trip, sacrificial protector sleeve for concentric disposal within an interior passageway of a tool having an internal geometry, wherein the sleeve has an external protrusion that corresponds with the internal geometry of the tool to secure the sleeve within the tool such that the sleeve extends over the internal geometry when the sleeve is concentrically disposed within the interior passageway of the tool; and wherein the sleeve is adapted to dissolve within a predetermined amount of time to expose the internal geometry after exposure to a first fluid;

wherein the sleeve comprises:

a first and second annular groove formed on the exterior surface of the single-trip, sacrificial protector sleeve;

a first annular seal disposed in the first groove that sealing engages the single-trip, sacrificial protector sleeve and the tool when the sleeve is concentrically disposed within the interior passageway of the tool; and a second annular seal disposed in the second groove that sealing engages the single-trip, sacrificial protector sleeve and the tool when the sleeve is concentrically disposed within the interior passageway of the tool wherein at least one of the first annular seal or the second annular seal is adapted to dissolve within a predetermined amount of time after exposure to the first fluid.

14. The single-trip, sacrificial protector sleeve of claim 13, wherein the tool is a tubing-retrievable safety valve and the internal geometry is a nipple profile.

15. The single-trip, sacrificial protector sleeve of claim 13, wherein the internal geometry is at least one of a nipple and a bore seal.

* * * * *